US008215951B2

(12) United States Patent
Sullivan

(10) Patent No.: US 8,215,951 B2
(45) Date of Patent: Jul. 10, 2012

(54) HIGH TEMPERATURE FIBER COMPOSITE BURNER SURFACE

(75) Inventor: John D. Sullivan, Fremont, CA (US)

(73) Assignee: Alzeta Corporation, Santa Clara, CA (US)

( * ) Notice: Subject to any disclaimer, the term of this patent is extended or adjusted under 35 U.S.C. 154(b) by 482 days.

(21) Appl. No.: 12/424,457

(22) Filed: Apr. 15, 2009

(65) Prior Publication Data

US 2010/0266972 A1 Oct. 21, 2010

(51) Int. Cl.
*F23D 14/14* (2006.01)

(52) U.S. Cl. ..... 431/329; 431/326; 431/327; 431/328; 428/131; 428/215; 428/311.11; 442/7

(58) Field of Classification Search ..... 431/326, 431/327, 328, 329; 428/131, 215, 311.11; 442/7

See application file for complete search history.

(56) References Cited

U.S. PATENT DOCUMENTS 3,199,573 A * 8/1965 Fiynn ..... 431/329
3,472,601 A * 10/1969 Kazuo et al. ..... 431/328
5,326,631 A * 7/1994 Carswell et al. ..... 442/7
5,595,816 A * 1/1997 Carswell ..... 428/131
6,033,211 A * 3/2000 Meyer ..... 431/329

OTHER PUBLICATIONS

PCT/US2010/030435 International Search Report dated Jun. 1, 2010.
PCT/US2010/030435 Written Opinion dated Jun. 1, 2010.

* cited by examiner

*Primary Examiner* — Steven B McAllister
*Assistant Examiner* — Avinash Savani
(74) *Attorney, Agent, or Firm* — Bryan Cave LLP

(57) ABSTRACT

A burner surface and creation method are provided. The burner surface includes a frame with a compact layer of unsintered metal and ceramic fibers that have been vacuum cast to a surface of the frame. The layer of unsintered metal and ceramic fibers is not greater than 0.5 inches, and is created without using substantial amounts of polymer pore forming or binding agents. The frame and compact layer additionally include a plurality of apertures that form holes through the burner surface plate. The burner surface plate may be formed by attaching a perforated screen to a fixture, inserting pins through apertures in the screen, introducing a suspension of metal and ceramic fibers into a space above the screen, vacuum casting the metal and ceramic fibers onto the screen to form a layer of metal and ceramic fibers, removing the plurality of pins from the apertures to form a corresponding set of apertures through the layer of metal and ceramic fibers, drying the layer of metal and ceramic fibers to remove moisture, applying colloidal silica to the layer of metal and ceramic fibers, and drying the burner surface.

25 Claims, 9 Drawing Sheets

HIGH TEMPERATURE FIBER COMPOSITE BURNER SURFACE

FIELD OF THE INVENTION

The present invention relates to burner surface plates and methods for production of these plates. More particularly, the invention is directed to burner surface plates formed from unsintered metal and ceramic fibers.

BACKGROUND OF THE INVENTION

Perforated plates formed from ceramic fibers have been disclosed in numerous patents such as U.S. Pat. No. 3,954,387 to Cooper, U.S. Pat. No. 4,504,218 to Mihara et al and U.S. Pat. No. 4,673,349 to Abe et al.

A common use of perforated ceramic plates is as burner surfaces of gas burners. U.S. Pat. No. 5,595,816 of Carswell (the "'816 patent"), which is incorporated herein by reference, for example, discloses an all-ceramic perforated plate useful as a burner face. The plates of U.S. Pat. No. 5,595,816 are formed by pressurized filtration of a suspension of chopped ceramic fibers in an aqueous dispersion of colloidal alumina or colloidal silica through a mold having a perforated filter base and a pin support base having pins that extend through and beyond the perforations of the filter base. After formation, the perforated layer of chopped fibers is transferred to a dryer operating at a temperature not exceeding 650° F., for conversion into a strong perforated plate. As described by this patent an advantage of perforated ceramic plates for water heaters is maximized if they can function as flameless infrared burners emitting radiant energy directly to the bottoms of the upright water tanks.

U.S. Pat. No. 5,326,631 to Carswell (the "'631 patent"), which is incorporated herein by reference, describes a burner made with metal fibers, ceramic fibers and a binding agent. In this patent, metal and ceramic fibers are suspended in water containing both dissolved and suspended agents commonly used in the manufacture of porous ceramic fiber burners. These agents include a binding or cementing material such as a dispersion of colloidal alumina, and a pore-forming removable polymer such as fine particles of methyl methacrylate.

There is potential to improve on the characteristics of prior art burner surfaces in terms of the strength and durability characteristics, performance, BTU per hour per square foot firing rates, and manufacturing cost.

SUMMARY OF THE INVENTION

The present invention provides an improved burner surface made from an unsintered composite of metal and ceramic fibers. In one embodiment of the present invention, a burner surface plate is provided comprising a frame having a first surface and an unsintered composite layer of metal and ceramic fibers vacuum cast to the first surface of the frame and having a thickness of typically 0.1 to 0.2 inches and preferably not greater than 0.5 inches. The composite layer is vacuum cast to the frame preferably without using pore-forming polymers or polymeric binding agent. An inorganic binder may be part of the manufacturing process, which contributes to the strength of the final composite fiber structure. The frame and the composite layer include a plurality of aligned apertures that form holes through the burner surface plate.

In another embodiment, a method of forming a burner surface is provided. The method includes attaching a perforated screen to a fixture; removably inserting a plurality of pins through a plurality of apertures in the screen; introducing a suspension of fibers without substantial amounts of pore-forming polymers or polymeric binding agents into a space above the screen; vacuum casting the fibers onto the screen to form a layer of fibers; removing the plurality of pins from the apertures to form a corresponding plurality of apertures through the layer of fibers; and drying the layer of fibers to remove moisture. The fibers are preferably metal and ceramic fibers. Additionally, the method may include applying inorganic particulates to the burner surface such that the particulates attach to the fibers, thereby providing an additional strengthening agent. In one embodiment, inorganic particulates are added by applying colloidal silica to the layer of metal and ceramic fibers (e.g., by coating, soaking, infiltrating, immersing, or the like), and the layer is then dried at a sufficient temperature to break at least a portion of the hydroxyl bonds of the colloidal silica but without sintering the fibers to form an unsintered metal and ceramic fiber surface.

Embodiments of the invention may improve on prior burner surfaces in one or more of the following ways:

- By casting the ceramic and metal fiber composite directly to a perforated screen, the structural integrity of the final product is significantly improved over previous designs.
- Casting the "pad material" from a ceramic and metal fiber composite (versus ceramic fibers only) the optical properties of the product are improved significantly over the properties of certain prior art burners. For example, in one embodiment the burner has higher emissivity and lower transmissivity to light in the wavelength range of interest for most gas-fired surface burners. This results in slower degradation of the burner pad material, longer burner life, and allows the casting of a much thinner layer of ceramic-metal fiber composite onto the support screen.
- In one embodiment, perforating the resultant "thin pad" represents a significant improvement over certain prior art burners with respect to air filtration requirements. Thin pads allow for some flexing, which results in a more durable burner surface. Perforating the burner surface also allows it to operate at higher surface heat release rates (relative to certain prior art burners) without encountering excessive pressure drop.

These advantages may also be achievable at lower cost per Btu than can be achieved by certain prior art burner technology.

These and other features and advantages of the invention will become apparent by reference to the following specification and by reference to the following drawings.

DETAILED DESCRIPTION OF THE PREFERRED EMBODIMENTS

It is to be understood that the present invention is not limited to the embodiments described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. Materials, processes and numerical examples described above are exemplary only, and should not be deemed to limit the claims. Further, as is apparent from the claims and specification, not all method steps need be performed in the exact order illustrated or claimed, but rather in any order that allows the proper formation of a plate described herein. Lastly, single layers of material could be formed as multiple layers of such or similar materials, and vice versa.

Figure 1:
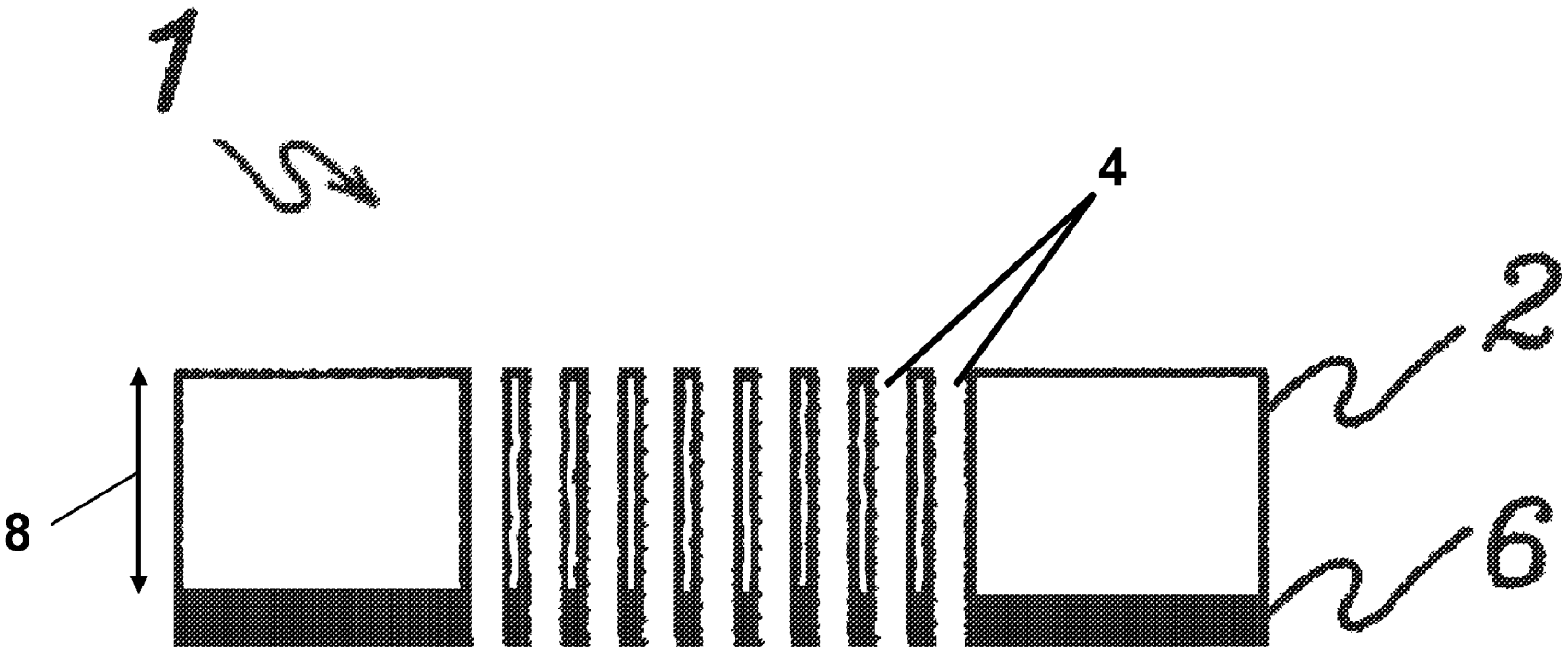
FIG. 1 shows a cross-section of a metal ceramic fiber plate that has been cast on a screen, according to an embodiment of the invention.

FIG. 1 shows a cross-section of a burner surface plate 1, including a vacuum cast layer 2 formed from an unsintered composite of metal and ceramic fibers that is coupled to a screen 6. The vacuum cast layer 2 and screen 6 are perforated and each includes a plurality of aligned apertures that form holes 4 through the plate 1. Screen 6 is preferably metal, but in alternate embodiments, screen 6 may be formed from any suitable material such as flame retardant plastic or composite material.

Vacuum cast layer 2 is comprised of an unsintered composite of metal and ceramic fibers that have been vacuum cast from a state as suspended components in a solution. In one embodiment, the solution does not contain any (or any substantial amount of) polymeric pore-forming agents or polymeric binding and cementing agents commonly found in the manufacture of porous ceramic fiber burners. The mixture may include inorganic binding agents, such as an aluminum colloid binder. Substantially eliminating polymers in the solution reduces the overall production cost of the burner surface plates, and reduces porosity which may cause fragility in some burner surfaces. By perforating the burner surface rather than making the surface more uniformly porous, manufacturing costs can be reduced and durability improved.

The metal fibers selected are preferably resistant to the high temperature and oxidizing conditions to which the burner surface may be exposed when placed in service. The selected metal is also preferably resistant to progressive oxidation, which under certain conditions could lead to disintegration or pulverization of the fiber in vacuum cast layer 2.

In one embodiment, iron-based and/or nickel-based alloys are used as fibers in vacuum cast layer 2. For example, iron-aluminum alloys or nickel-chromium alloys can provide fibers with a desired resistance to high temperature and oxidation. Suitable iron-aluminum alloys may contain by weight 4% to 10% aluminum, 16% to 24% chromium, 0% to 26% nickel and often fractional percentages of yttrium and silica. Suitable nickel-chromium alloys may contain by weight 15% to 30% chromium, 0% to 5% aluminum, 0% to 8% iron and often fractional percentages of yttrium and silica. The preferred alloys typically contain chromium.

In one embodiment, the metal fiber diameter is less than about 50 microns and usually in the range of about 8 to 25 microns while the fiber length is in the range of about 0.1 to 3 millimeters. The metal fibers may be straight or curled.

In one embodiment, the ceramic fiber is formed of an amorphous alumina-silica material. For example, the ceramic fiber may be formed of chopped alumina-silica fibers where each fiber has a length less than about ½".

The proportioning of ceramic fibers to metal in vacuum cast layer 2 may vary over a wide range from less than 0.2 to over 5, usually varied over the range of 0.2 to 2 weight parts of ceramic fiber per weight part of metal fiber. In one embodiment, the preferred weight ratio is between 0.25 and 1. In one alternate embodiment, the layer 2 is cast from 100% metal fiber. In other embodiments, a mass ratio of metal fibers to total fibers in the suspension is between 0.20 and 1. In one embodiment the vacuum cast layer 2 has a thickness in the range of 1/16"-¼", and in one embodiment is preferably about ⅛" thick. Relative to certain prior art burner surfaces, layer 2 can be significantly thinner because of the relatively high percentage of metal fiber and because it is significantly denser since it has no porosity created by polymer. This ability to cast the thinner pad is advantageous. For example, it allows the pad to flex more without cracking.

In one embodiment, the apertures 4 in layer 2 and screen 6 have a diameter that is less than or equal to about half of the thickness, for example, less than or equal to about 1/16" for a layer having a thickness of about ⅛". With thinner pads, holes that are approximately 0.035-0.050 inch diameter may be used. The diameter and length of the apertures are preferably designed to make the burner less likely to flash back. In one embodiment, the diameter of the apertures are selected to be as large as possible so that particles do not get stuck within and plug the holes, but not so large as to cause flashback.

Screen 6 of FIG. 1 provides support for vacuum cast layer 2, as well as additionally providing strength and durability to the overall burner surface. Screen 6 may be made of any material capable of supporting vacuum cast layer 6 under the designated temperature and operating conditions of metal ceramic fiber plate 1. In one embodiment, screen 6 is composed of about 20-22 gauge stainless steel. Vacuum cast layer 2 is cast directly onto screen 6 during the creation of vacuum cast layer 2 from a solution, as described below. When used as a burner surface, screen 6 may be bolted or cast to a plenum as the bottom surface of metal ceramic plate 1 in a variety of ways. For example, since the screen is steel, it can include bolts or nuts for fastening, it can be welded to a plenum, or it can be riveted if there are holes in the metal. In one embodiment, the screen can be attached to the plenum before casting in order to provide a one-piece casting of a plenum and burner surface. Such a design may provide cost advantages.

Figure 2:
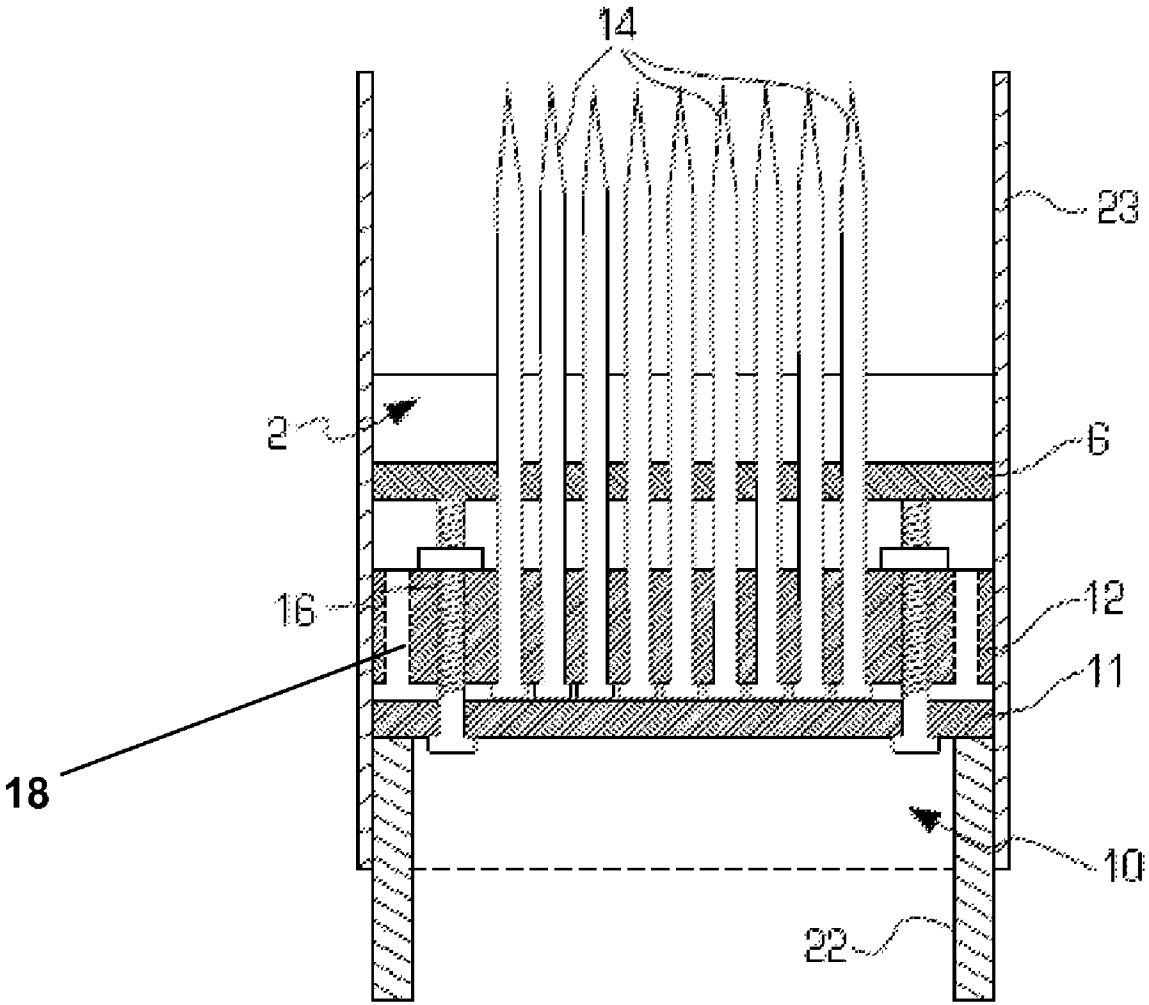
FIG. 2 shows a cross section of a casting fixture including a pin fixture along with a layer formed from an unsintered composite of metal and ceramic fibers cast on a screen, according to an embodiment of the invention.

FIG. 2 is a cross section of vacuum-casting fixture 10 according to one embodiment of the invention. The fixture 10 includes an upper receptacle or tube 23 that receives a suspension of metal and ceramic fibers, and lower receptacle or tube 22 through which liquid passing through fixture 10 drains. When a metal and ceramic fiber suspension is drawn through the fixture 10, layer 2 is formed on top of screen 6 to form the burner surface plate 1. Tube 23 provides a seal around plate 12 and tube 22. A vacuum pump (not shown) is connected to tube 22 to draw liquid through the pores of casting base plate 12 and screen 6, as well as through the annular clearances between pins 14 and the perforations of base plate 12. There may also be additional perforations 18 in base plate 12, or drain holes around the sides of the plate to let the liquid get to the bottom of the casting fixture where the suction line is.

Fasteners 16 may provide two functions. The first is to secure plate 11 to plate 12 to help hold pins 14 in place. The second function is to act as "standoffs" that screen 6 can rest on to provide some separation between screen 6 and plate 12. If casting is done with screen 6 on top of fasteners 16, then screen 6 can be held in place by gravity. In other orientations, fasteners 16 may also be used to fasten screen 6 to the rest of the fixture.

In one embodiment, pins 14 may be approximately 0.050-0.078 inches in diameter and the perforations of screen 6 may be about 0.065-0.90 inch. The holes in plate 12, the pin holder, are about 0.055-0.083. Plate 12 is about ¼ inch thick, so the tight hole tolerance and the thickness of the plate keep the pins aligned so that they line up with the 0.065-0.90 inch holes in screen 6. Pins 14 are held in place by metal plate 12, with the heads of the pins 14 pressed between plates 11 and 12 for additional support. In order to function as a flame arrester, the hole depth created by the screen 6 and vacuum cast layer 2 is preferably greater than or equal to about twice the diameter of the holes created by each pin at the thickness directly around that pin. In another potential embodiment, pins 14 may be of varying diameter and the spacing between the centers of individual pins may vary in the pattern of pins 14.

When the metal and ceramic fiber suspension is filtered through the system it leaves a compact pad or layer 2 of metal and ceramic fibers around pins 14. When layer 2 of metal and ceramic fibers reaches a desired thickness, the supply of the suspension to receptacle 23 is stopped and the vacuum is halted. Alternately, vacuum can be stopped to halt the flow of the suspension fluid and then the fixture can be removed from a pool or bath of the suspension fluid.

Screen 6 and the layer of metal and ceramic fibers 2 can be raised vertically out of the fixture until the pins 14 have been completely removed from contact with the metal and ceramic fiber layer 2 and screen 6. In embodiments, where fasteners 16 were used to attach the screen 6 to the fixture, they can be disconnected prior to removing screen 6 from the rest of the fixture. The perforated pad 2 of chopped metal and ceramic fibers and screen 6 can then be transferred to drying oven to convert the wet deformable fiber pad into a dry rigid perforated plate. The drying oven is at a temperature that dries the burner surface plate without sintering the metal and ceramic fibers to form an unsintered composite layer of metal and ceramic fibers 2 that is attached to screen 6.

To vacuum-form another metal ceramic fiber pad, another screen 6 is placed over pins 14 and attached to the fixture using fasteners 16. The apparatus is then ready and the suspension of metal and ceramic fibers can be reintroduced into tube 23 and vacuum-drawn thereof through mold 10.

Figure 3:
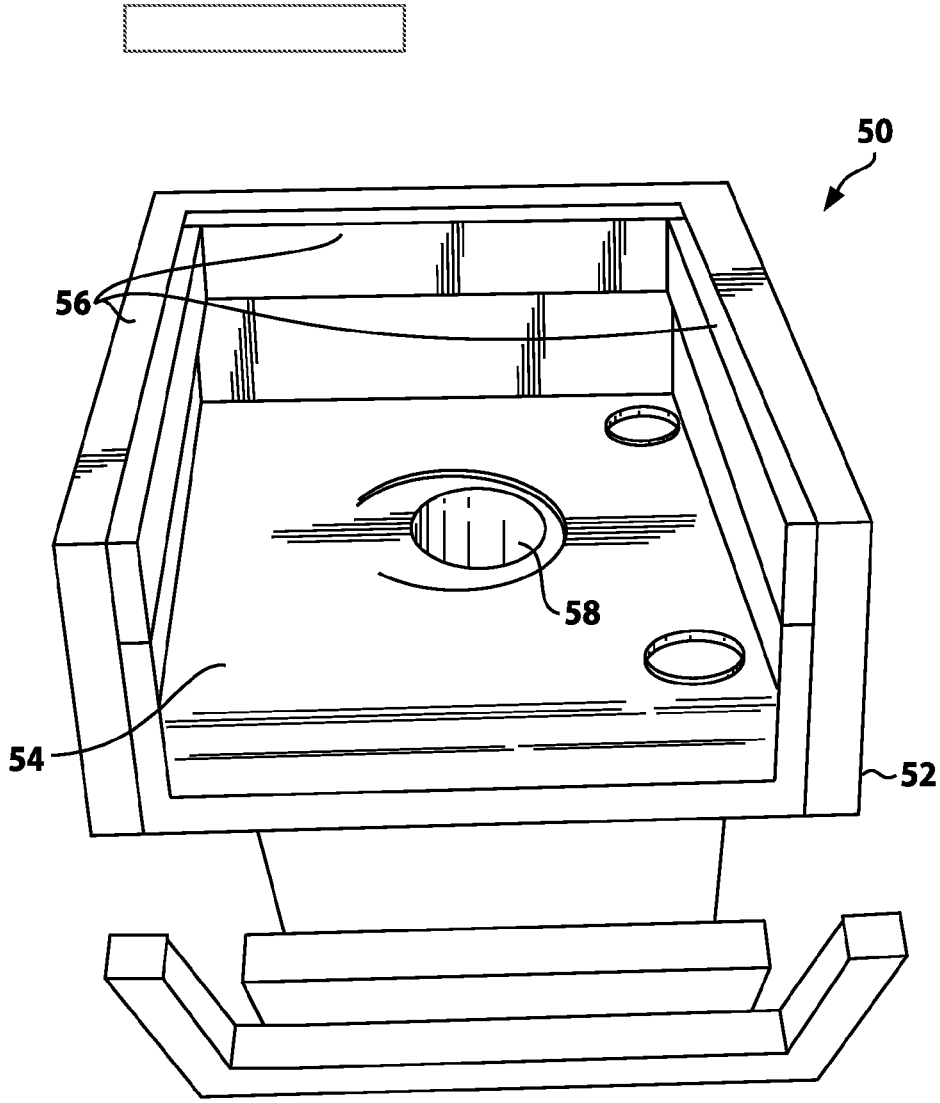
FIG. 3 shows a perspective view of a vacuum frame assembly, according to one embodiment of the invention.
Figure 4:
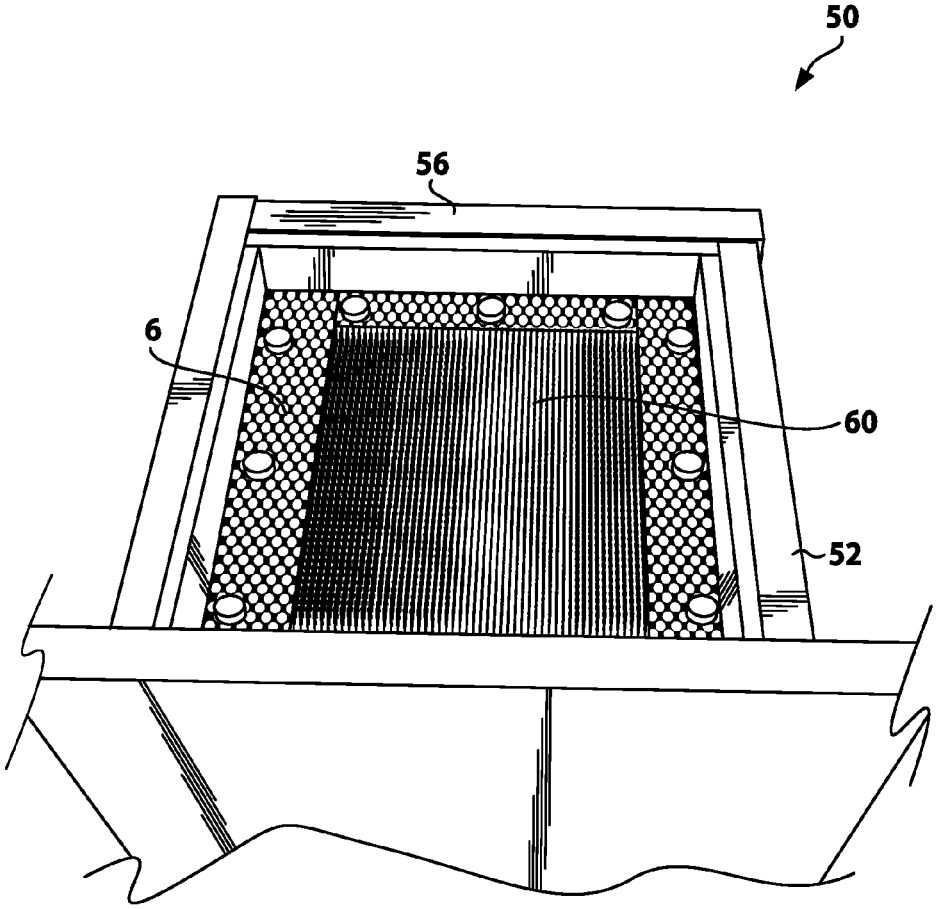
FIG. 4 shows a top view of an assembled casting fixture, according to one embodiment of the invention.

FIGS. 3-6 show a casting fixture assembly and process, according to another embodiment of the invention. FIG. 3 shows a vacuum frame assembly 50. Vacuum frame assembly 50 includes a receptacle portion 52 for receiving a pin fixture. Receptacle portion 52 has a generally square bottom 54 and includes 4 sidewalls 56. In FIG. 3, vacuum frame assembly 50 is shown with a sidewall detached, which allows for insertion and removal of a pin fixture. The bottom of receptacle portion 52 includes a hole 58 that is fluidly connected to the vacuum source (not shown). FIG. 4 illustrates a top view of an assembled casting fixture including vacuum assembly 50 (with removable sidewall 56 attached), and a pin fixture 60 with an attached perforated metal plate 6.

Figure 5:
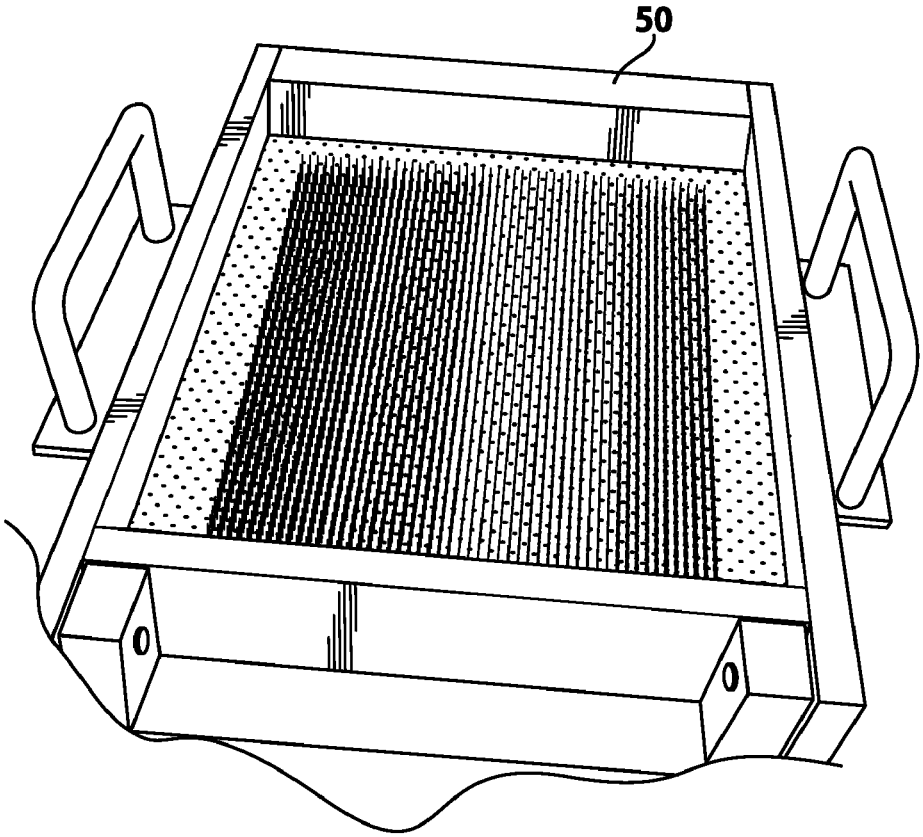
FIG. 5 shows a casting fixture with solids deposited to form a metal ceramic surface before the pins of the casting fixture have been retracted.
Figure 6:
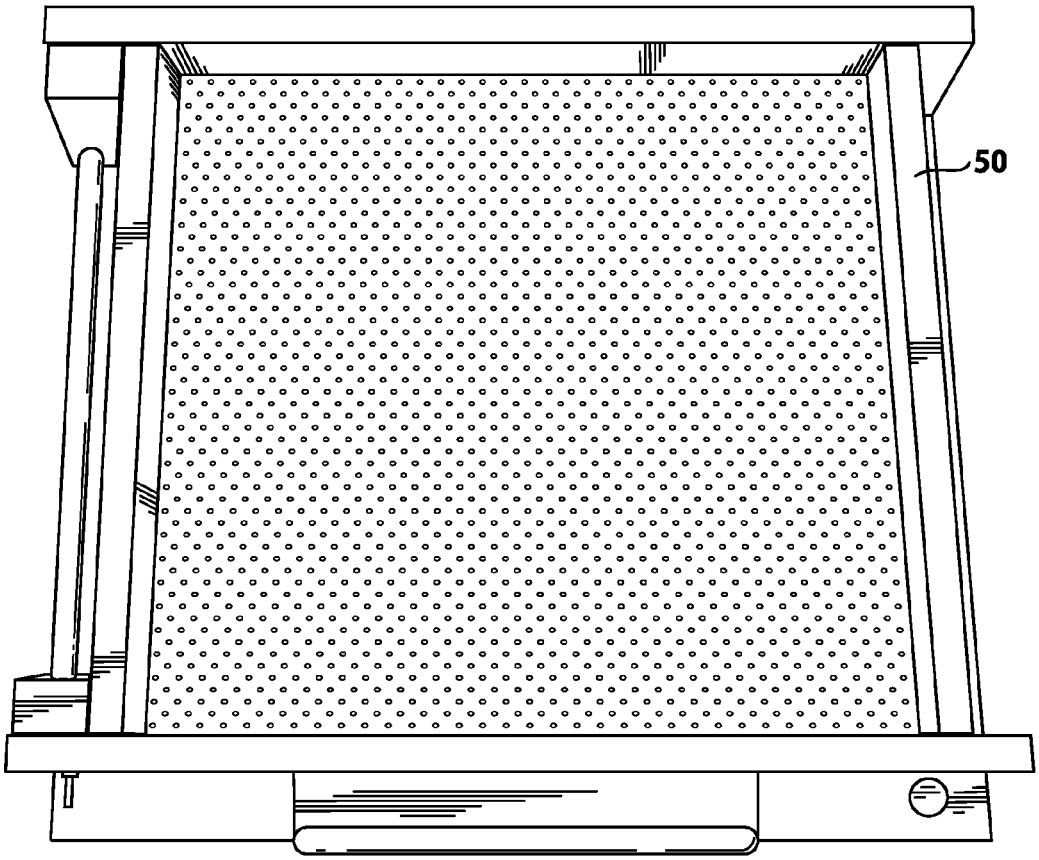
FIG. 6 shows a burner surface after the pins of the casting fixture have been retracted.

Once the pin fixture 60 is inserted and the removable sidewall is attached, the vacuum assembly 50 is submerged into a container holding the slurry mixture. A vacuum source draws the slurry onto the top surface of the pin fixture which is holding the metal plate 6. The metal ceramic solids remain on the top of the metal plate 6, while the liquid passes through the fixture. FIG. 5 shows the fixture removed from the solution with the metal ceramic solids deposited on the metal plate 6. The metal pins can then be retracted from the pin fixture 60, leaving the burner surface behind, as shown in FIG. 6. The burner surface includes the perforated screen 6 and the top layer of the metal ceramic fibers 2. The burner surface may be removed from the fixture and dried (e.g., at 180 degrees F.) to remove water. In one embodiment, another liquid may be added to the burner surface, such as colloidal silica. The burner surface is then dried again at 600 degrees F. in order to remove moisture without sintering the fibers, and after these steps it is ready for use. The treatment with the colloidal silica provides additional cementing of the fibers together and makes the burner surface harder and more resistant to water. In other embodiments, colloidal alumina or other additives may be used to provide additional cementing.

Figure 7:
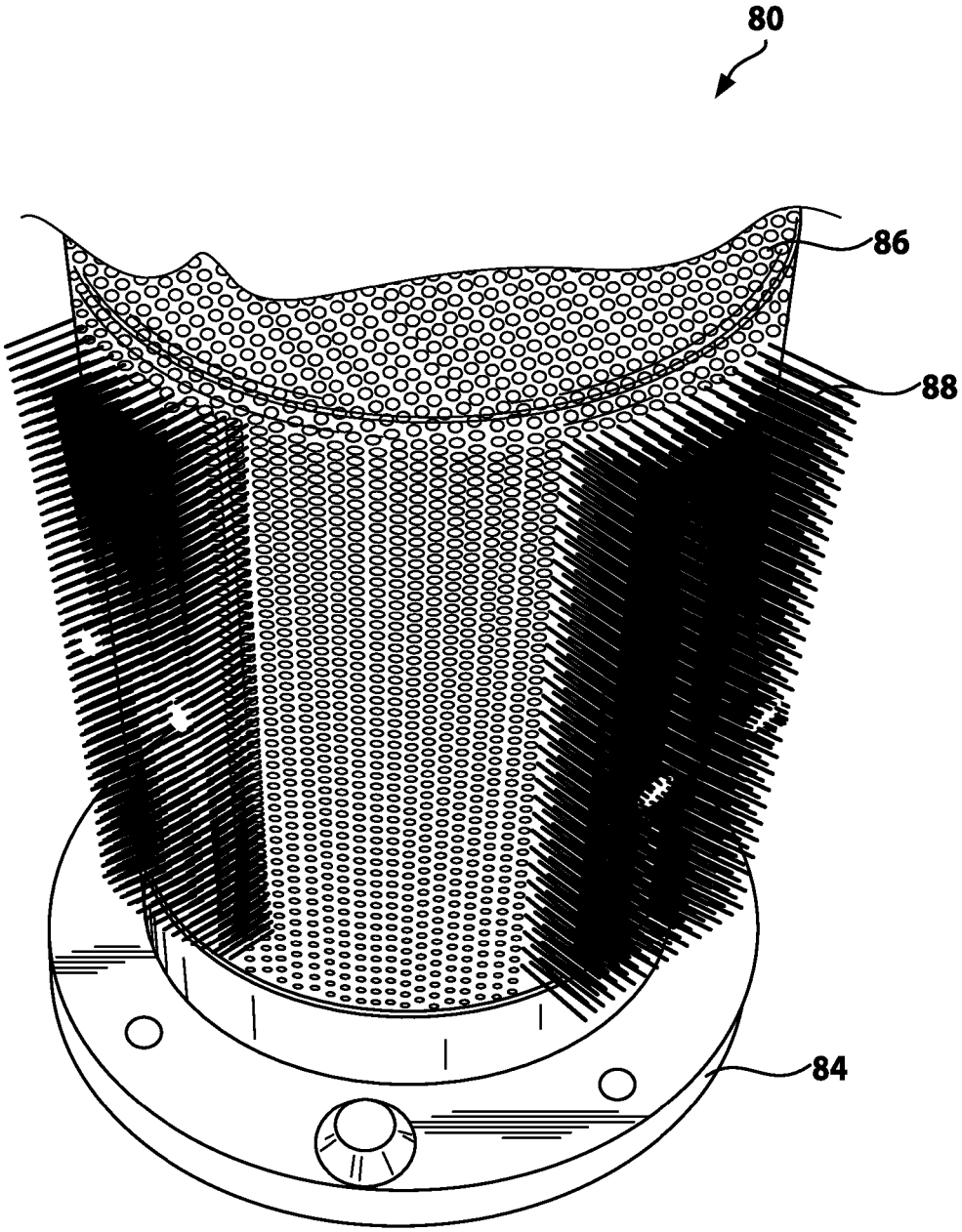
FIG. 7 shows a cylindrical casting fixture, according to one embodiment of the invention.
Figure 8:
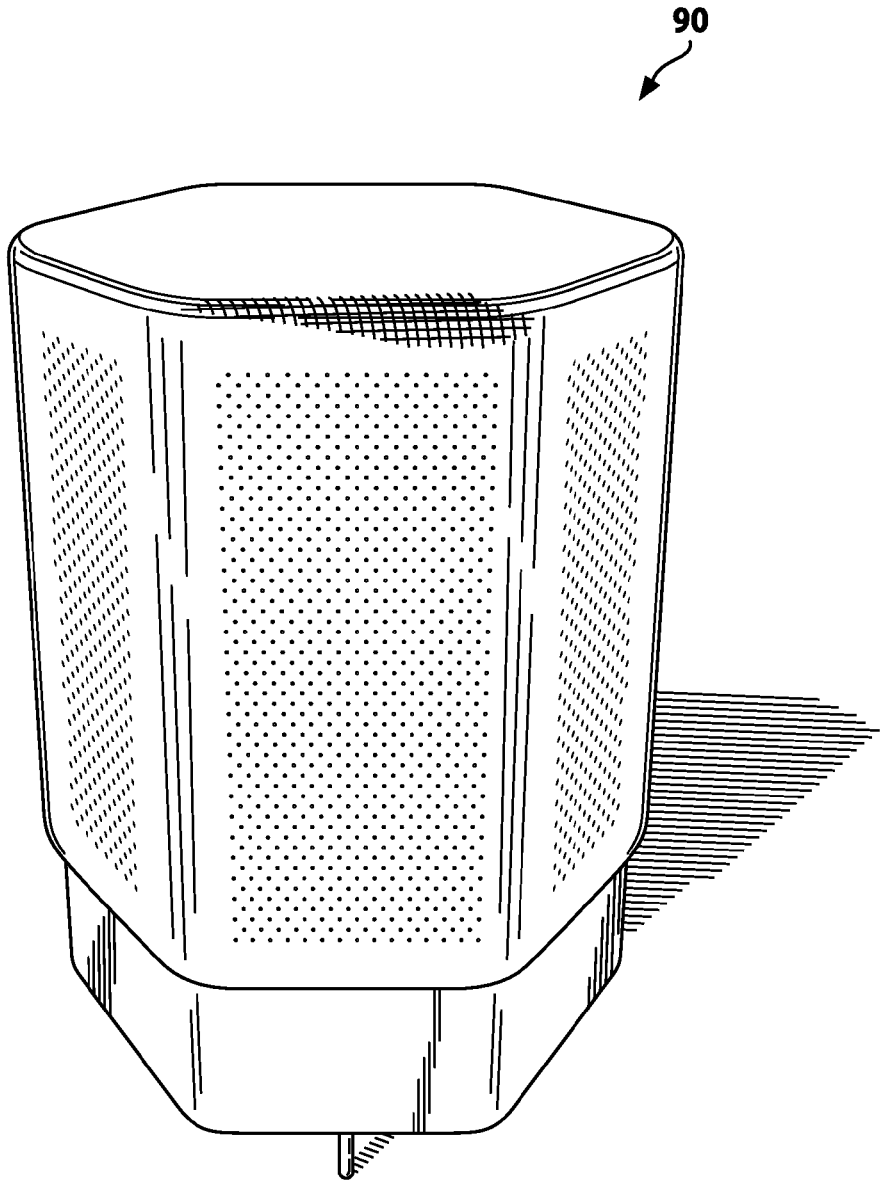
FIG. 8 shows a three-dimensional hexagonal casting fixture, according to one embodiment of the invention.

One of ordinary skill in the art will appreciate that the casting fixture can have any desired shape or size. For example, FIG. 7 shows a casting fixture 80 having a cylindrical geometry instead of a flat plate. Fixture 80 includes cylindrical metal frame 86, retractable pins 88 and a base portion 84 onto which metal frame 86 is removably attached. FIG. 8 illustrates a three-dimensional hexagonal casting fixture 90 after the vacuum casting process is completed and the pins removed. In other embodiments, various two- and three-dimensional frames can be used to form burner surfaces using substantially identical vacuum casting methods.

Figure 9:
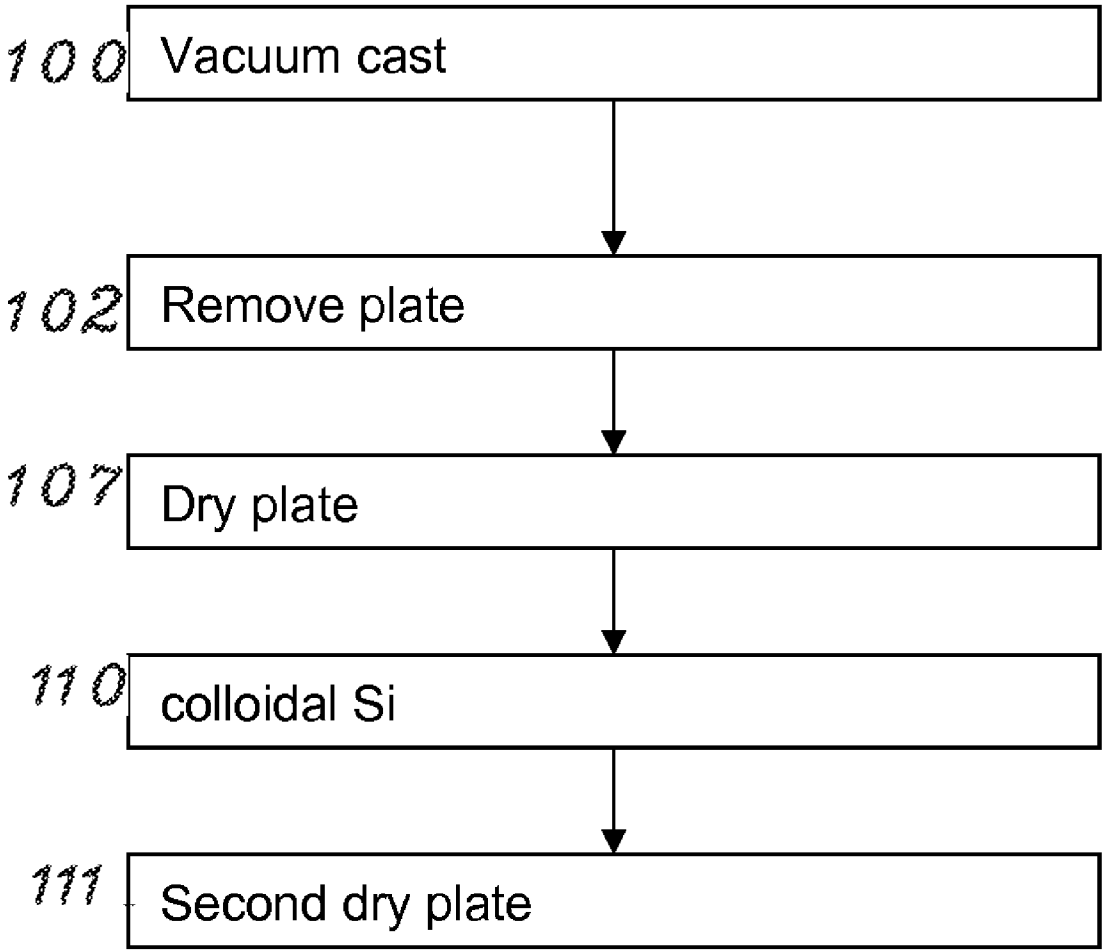
FIG. 9 is a flow chart detailing one potential method of fabricating a metal ceramic fiber plate on a screen, according to an embodiment of the invention.

FIG. 9 describes a process for fabricating a burner surface formed from a composite of unsintered metal and ceramic fibers, according to one embodiment of the invention. In step 100, the metal ceramic fibers are vacuum cast onto a perforated metal plate, as described above in connection with either FIG. 2 or FIGS. 3-6. In step 102, the metal ceramic fiber plate 1 that will form the burner surface may be removed from the fixture. Following removal of the metal ceramic fiber plate 1 from the fixture, the metal ceramic fiber plate 1 is placed in a drying oven to dry the plate, as shown in step 107. In one embodiment, the plate 1 is dried at 180 degrees F.

Following the removal of moisture in step 107, colloidal silica may be added to the burner surface by dipping, brushing or spraying the basic solution of colloidal silica to metal ceramic fiber plate 1 as shown in step 110. After the colloidal silica has dried, the plate is protected against damage from contact with water. In one embodiment, the burner surface receives a second application of colloidal silica to further protect the plate.

In step 111, a second drying operation is performed at around 600 to 650 degrees F. in order to break the hydroxyls contained in metal ceramic fiber plate 1 without sintering the metal and ceramic fibers. This functions as a hardening step to further improve the performance of the plate 1.

It should be noted that, as used herein, the terms "over" and "on" both inclusively include "directly on" (no intermediate materials, elements or space disposed between) and "indirectly on" (intermediate materials, elements or space disposed between). Likewise, the term "adjacent" includes "directly adjacent" (no intermediate materials, elements or space disposed between) and "indirectly adjacent" (intermediate materials, elements or space disposed between).

What is claimed is:

1. A burner surface plate comprising: a screen having a first surface, the screen being a metal screen; an unsintered composite layer of metal fibers and ceramic fibers vacuum cast to the first surface of the screen and having a thickness not greater than 0.5 inches, the metal fibers being distinct from the ceramic fibers, wherein the composite layer is vacuum cast to the screen without using substantial amounts of polymer agents; and wherein the frame first surface and the composite layer include a plurality of aligned apertures trough the first surface and unsintered composite layer, and wherein the burner surface plate is free-standing and flexible.

2. The burner surface plate of claim 1 wherein the screen is a screen made from plastic.

3. The burner surface plate of claim 1 wherein the screen is generally flat.

4. The burner surface plate of claim 1 wherein the frame screen is three-dimensional.

5. The burner surface plate of claim 1 further comprising an amount of silica.

6. The burner surface plate of claim 1 wherein the apertures have a diameter that is less than or equal to about half of the thickness of the plate.

7. The burner surface plate of claim 1 wherein the ceramic fibers have a maximum length of about 0.1 inch.

8. The burner surface plate of claim 1 wherein the metal fibers comprise 4% to 10% aluminum, 16% to 24% chromium, and 0% to 26% nickel.

9. The burner surface plate of claim 8 wherein the metal fibers of the composite layer further comprise yttrium and silica.

10. The burner surface plate of claim 1 wherein the metal screen is formed from stainless steel of about 20-22 gauge.

11. A method of forming a burner surface plate comprising: attaching a screen having a plurality of apertures to a fixture, the screen being a metal screen; removably inserting a plurality of pins through the plurality of apertures in the screen; introducing a suspension of metal fibers and ceramic fibers without a substantial amount of polymer agents into a space above the screen, wherein the metal fibers are distinct from the ceramic fibers; vacuum casting the fibers onto the screen to form a layer of fibers; removing the plurality of pins from the apertures to form a corresponding plurality of apertures through the layer of fibers; removing the screen and layer of fibers vacuum cast thereto from the fixture; drying the layer of fibers to remove moisture; applying colloidal silica to the layer of fibers; and drying the layer of fibers at a sufficient temperature to break at least a portion of hydroxyl bonds of the applied colloidal silica but without sintering the fibers to form a free-standing burner surface plate, and wherein the burner surface plate is flexible.

12. The method of claim 11 wherein the fibers comprise metal and ceramic fibers.

13. The method of claim 12 wherein the ceramic fibers comprise amorphous alumina-silica fibers.

14. The method of claim 12 wherein each of the plurality of pins has a diameter less than 0.08 inches and a distance to the nearest pin less than 0.13 inches center to center.

15. The method of claim 11 wherein a mass ratio of metal fibers to total fibers in the suspension is between 0.20 and 1.

16. The method of claim 12 wherein ceramic fibers have a maximum length of about 0.1 inch.

17. The method of claim 12 wherein metal fibers comprise 4% to 10% aluminum, 16% to 24% chromium, and 0% to 26% nickel.

18. The method of claim 17 wherein the metal fibers further comprise yttrium and silica.

19. The method of claim 12 wherein the screen is made of stainless steel.

20. The method of claim 12 wherein the screen forms a 2-dimensional shape.

21. The method of claim 12 wherein the screen forms a 3-dimensional shape.

22. The method of claim 12 wherein the screen is metal.

23. The method of claim 12 wherein the screen is plastic.

24. The burner surface plate of claim 1 having a thickness of 1/16 to 1/4 inches.

25. The burner surface plate of claim 6 having a thickness of 1/16 to 1/4 inches.

* * * * *